US006318968B1

(12) United States Patent
Oliver et al.

(10) Patent No.: US 6,318,968 B1
(45) Date of Patent: Nov. 20, 2001

(54) MAGNETORHEOLOGICAL FLUID PUMPING SYSTEM

(75) Inventors: Michael Leslie Oliver, Xenia; William Charles Kruckemeyer, Beavercreek; Richard Edward Longhouse, Dayton, all of OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/540,583

(22) Filed: Mar. 31, 2000

(51) Int. Cl.[7] ..... F04B 19/24; F04B 37/02; H02K 44/00

(52) U.S. Cl. ..... 417/53; 417/48; 417/50

(58) Field of Search ..... 417/48, 50, 199.1, 417/205, 212, 53

(56) References Cited

U.S. PATENT DOCUMENTS

| | | | | |
|---|---|---|---|---|
| 5,275,537 | * | 1/1994 | Gasser | 417/48 |
| 5,816,372 | * | 10/1998 | Carlson et al. | 188/267.2 |
| 5,845,752 | * | 12/1998 | Gopalswamy et al. | 192/21.5 |
| 5,848,678 | * | 12/1998 | Johnston et al. | 192/21.5 |
| 5,896,964 | * | 4/1999 | Johnston et al. | 192/21.5 |
| 5,896,965 | * | 4/1999 | Gopalswamy et al. | 192/21.5 |
| 6,149,391 | * | 11/2000 | Pohl et al. | 417/48 |
| 6,234,060 | * | 5/2001 | Jolly | 91/361 |

* cited by examiner

*Primary Examiner*—Charles G. Freay
*Assistant Examiner*—Michael K. Gray
(74) *Attorney, Agent, or Firm*—Robert M. Sigler

(57) ABSTRACT

An improved magnetorheological fluid pumping system and method are provided which effectively dispense a predetermined amount of magnetorheological fluid for delivery to a MR device such as a damper assembly, for example, during manufacture. The fluid pumping system includes a pump having inlet and outlet valves, a reciprocally mounted piston, a stroke operator device for controlling the movement of the piston and an electronic controller for operating the stroke operator device and the inlet and outlet valves. Importantly, the inlet and outlet valves include an annular flow gap and a magnetic field generating assembly operable in an energized state to generate a magnetic field across the flow gap to cause magnetorheological fluid flowing through the gap to experience a magnetorheological effect sufficient to prevent flow through the gap and in a de-energized state to permit flow through the gap. In one embodiment, the system includes inlet and outlet valves mounted at one end of a pump housing on opposite sides of a common feed chamber to control fluid flow into and out of a pump chamber. In a second embodiment, the system includes an inlet valve integrated into the piston for controlling flow between a receiving chamber on one side of the piston and the pump chamber on the opposite side of the piston. The valves are alternately energized and de-energized before retraction and dispensing strokes of the piston resulting in simple effective control of fluid dispensing.

20 Claims, 5 Drawing Sheets

MAGNETORHEOLOGICAL FLUID PUMPING SYSTEM

TECHNICAL FIELD

The technical field of the invention is the dispensing of magnetorheological fluid to a magnetorheological device.

BACKGROUND OF THE INVENTION

Magnetorheological fluids that comprise suspensions of ferromagnetic particles such as iron or iron alloys in a fluid medium have flow characteristics that can change by several orders of magnitude within milliseconds when subjected to a suitable magnetic field due to suspension of the particles. The ferromagnetic particles remain suspended under the influence of magnetic fields and applied forces. Such magnetorheological fluids have been found to have desirable electro-magnetomechanical interactive properties for advantageous use in a variety of magnetorheological (MR) damping devices, such brakes, clutches, mounts and dampers.

Regardless of the type of device, the magnetorheological fluid must be loaded or injected into the device during manufacture. Magnetorheological fluids tend to be costly; and, depending on what additives are used for different applications, the release of such fluids to the environment might be undesirable. Thus, it is desirable to dispense precisely the correct volume of fluid to the device, with no spillage.

SUMMARY OF THE INVENTION

It is an object of the present invention, therefore, to provide a magnetorheological (MR) fluid dispensing device and system which effectively dispenses a predetermined amount of fluid for delivery to an MR device in a simple and cost effective manner. The MR fluid dispensing device and system disclosed is particularly, though not exclusively, adapted for a magnetorheological damper.

This and other objects of the present invention are achieved by providing a magnetorheological fluid pumping system for dispensing fluid for delivery to a magnetorheological device, comprising a pump including a bore, a piston mounted for reciprocal movement in the bore to form a pump chamber wherein the piston is movable through a retraction stroke to permit fluid flow into the pump chamber and a dispensing stroke to dispense fluid from the pump chamber. The pumping system also includes an outlet circuit for directing flow from the pump chamber and an outlet valve and/or an inlet valve. The outlet valve is positioned along the outlet circuit for controlling fluid flow from the pump chamber while the inlet valve is positioned to control fluid flow into the pump chamber. Both valves include an annular flow gap and a magnetic field generating assembly operable in an energized state to generate a magnetic field across the annular flow gap to cause magnetorheological fluid flowing through the gap to experience a magnetorheological effect sufficient to prevent flow through the gap and in a de-energized state to permit flow through the gap.

The pump may include a pump housing wherein the inlet valve and the outlet valve are mounted on the pump housing. The system may further include an electronic controller connected to the inlet and the outlet valves for controlling the energization and de-energization of the respective magnetic field generating assemblies. In addition, a stroke operator device may be provided to move the piston through the retraction and dispensing strokes. Also, the outlet valve may be positioned in axial alignment with a longitudinal stroke axis of the piston. In one embodiment, the inlet valve may be mounted on the piston. In this embodiment, the pump may include a pump inlet port at a first end and an outlet port at a second end opposite the first end with the outlet valve positioned adjacent the outlet port. In another embodiment, the pump may include a common feed chamber positioned at one end of the bore with the inlet and outlet valves positioned along the common feed chamber a spaced distance from one another. In this case, the bore extends transversely from the common feed chamber.

The present invention is also directed to a method of dispensing magnetorheological fluid for delivery to a magnetorheological device, comprising the steps of providing a pump including a bore and a piston mounted for reciprocal movement in the bore to form a pump chamber and reciprocating the piston through a retraction stroke to permit fluid flow into the pump chamber and a dispensing stroke to dispense fluid from the pump chamber. The method further includes the steps of providing an inlet valve to control fluid flow into the pump chamber wherein the inlet valve includes the gap and a magnetic field generating assembly operable in the energized and de-energized states and providing an outlet valve for controlling fluid flow from the pump chamber which also includes an annular flow gap and a magnetic field generating assembly operable in energized and de-energized states. The method further includes the steps of maintaining the outlet valve magnetic field generating assembly in the energized state and the inlet valve magnetic field generating assembly in the de-energized state during the retraction stroke of the piston. The method further includes the step of maintaining the outlet valve magnetic field generating assembly in the de-energized state and the inlet valve magnetic field generating assembly in the energized state during the dispensing stroke of the piston.

DESCRIPTION OF THE PREFERRED EMBODIMENT

Figure 1:
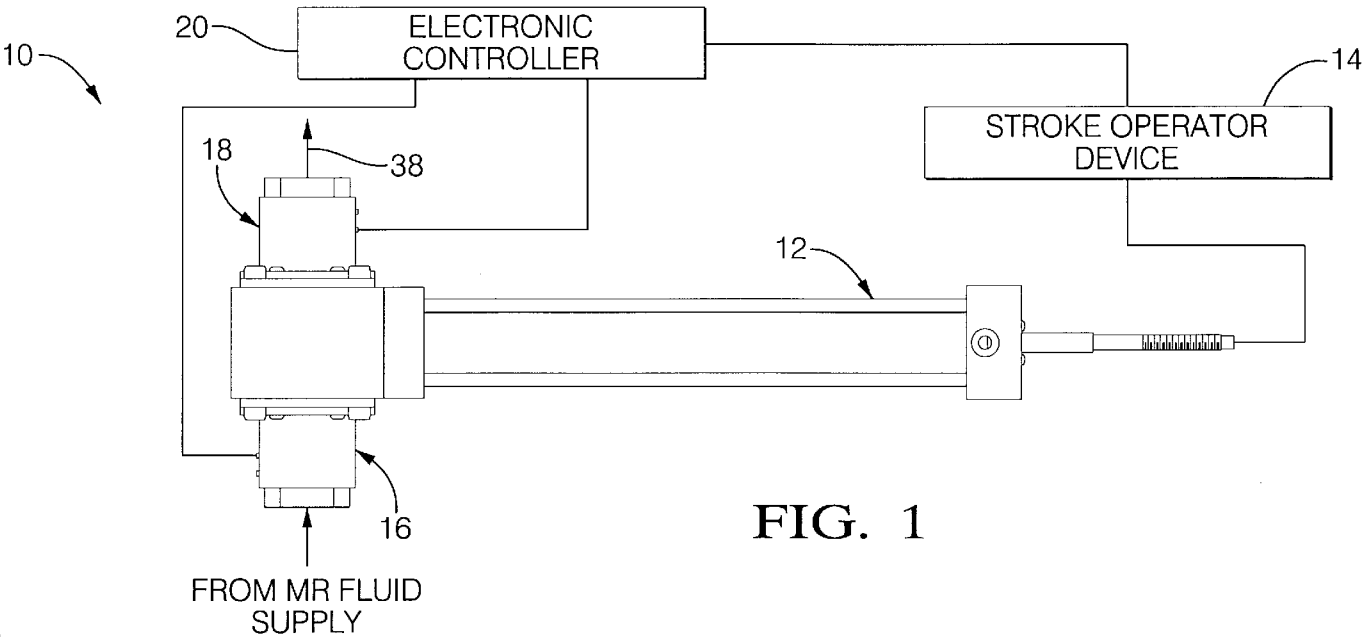
FIG. 1 is a schematic diagram of the magnetorheological fluid pumping system of the present invention.

The magnetorheological fluid dispensing device and method of this invention are described in a preferred environment of the filling of a magnetorheological damper such as is used in motor vehicle suspension systems. Referring to FIG. 1, there is shown the magnetorheological fluid pumping system of the present invention, indicated generally at 10, designed to effectively dispense magnetorheological damper fluid for delivery to a magnetorheological (MR) damper (not shown). MR fluid pumping system 10 is designed to accurately dispense predetermined quantities of MR fluid in a simple and cost effective manner. In the first embodiment shown in FIG. 1, MR fluid pumping system 10 includes a pump 12, a stroke operator device 14 operatively connected to pump 12, an inlet valve 16 for controlling fluid flow into pump 12, an outlet valve 18 for controlling fluid flow from pump 12 and an electronic controller 20 for controlling the operation of stroke operator device 14, inlet valve 16 and outlet valve 18 as discussed more fully hereinbelow.

Figure 2A:
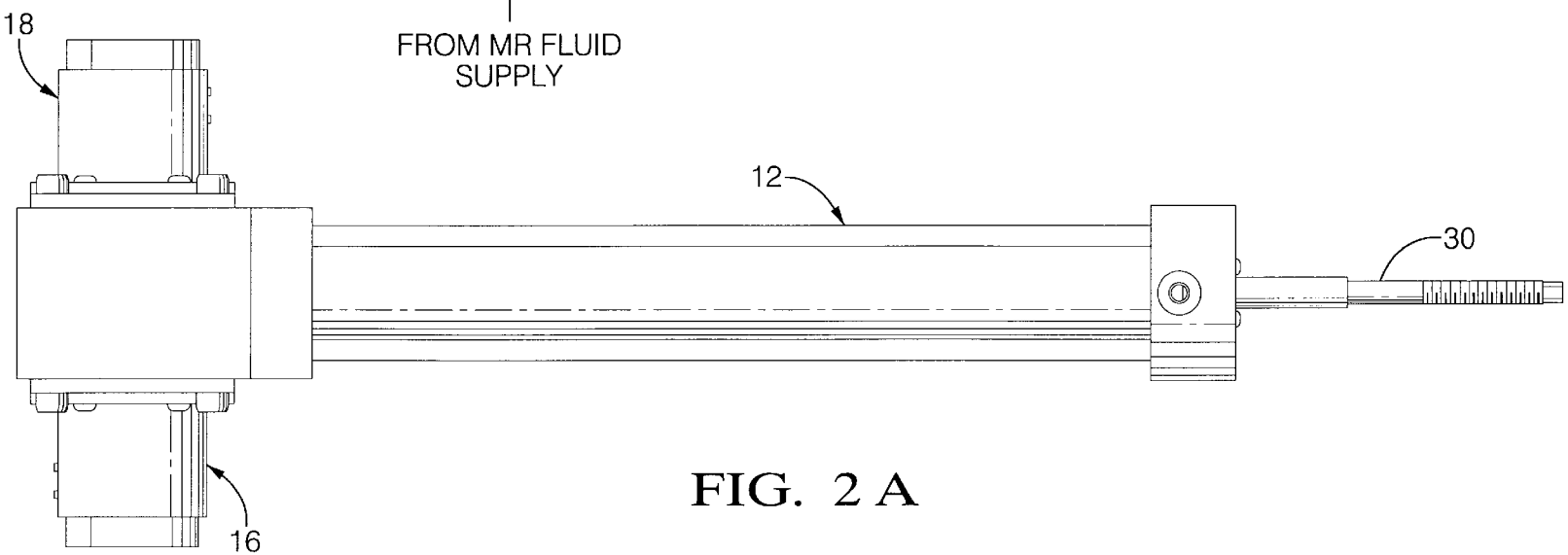
FIG. 2A is a plan view of the pump of the system of FIG. 1.
Figure 2B:
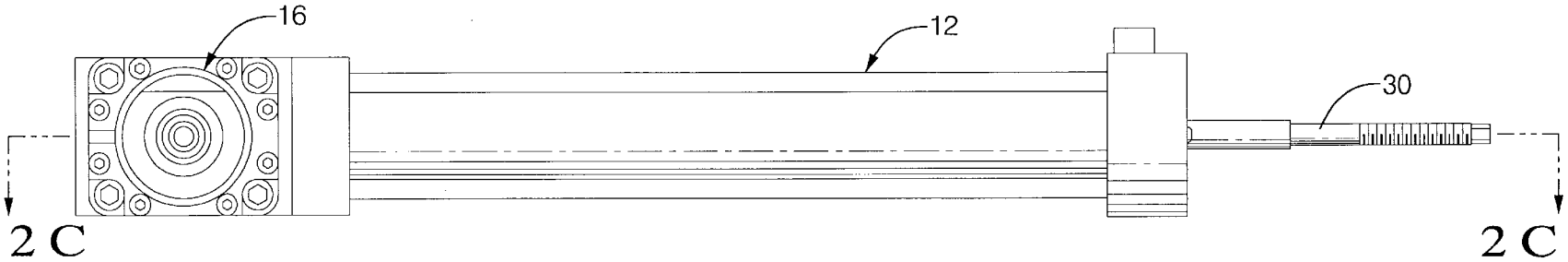
FIG. 2B is a side view of the pump of FIG. 2A.
Figure 2C:
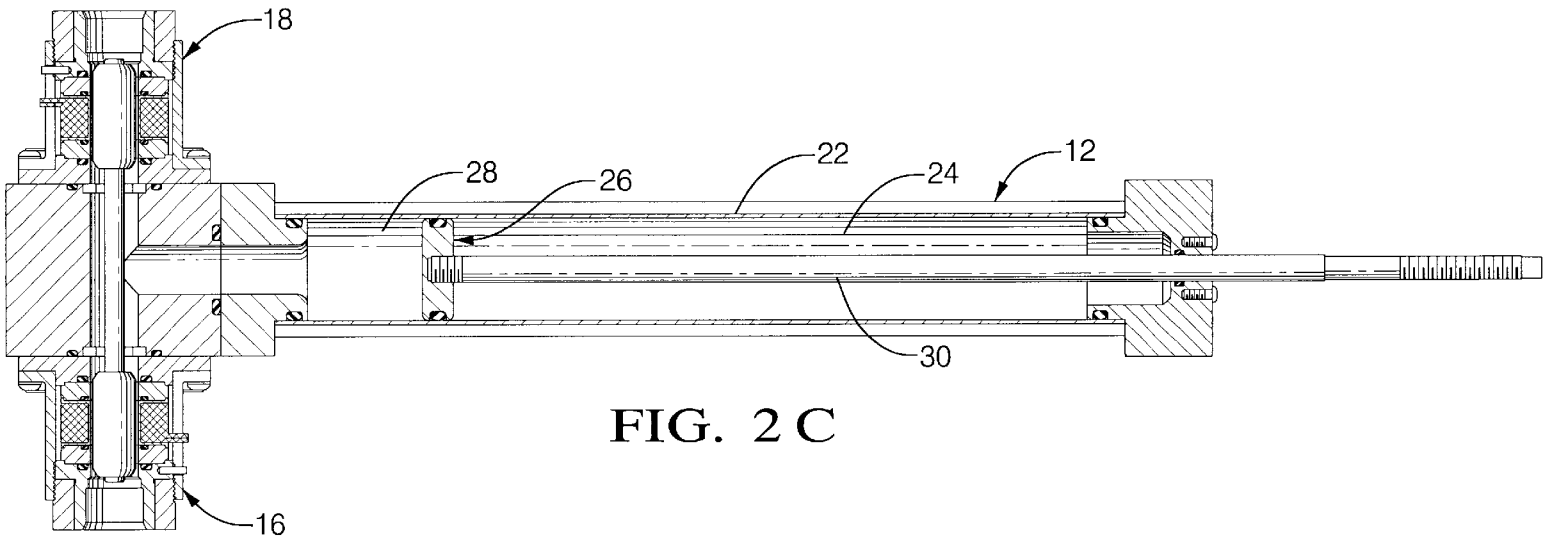
FIG. 2C is a cross sectional view of the pump of the present embodiment taken along plane 2C—2C in FIG. 2B.
Figure 3:
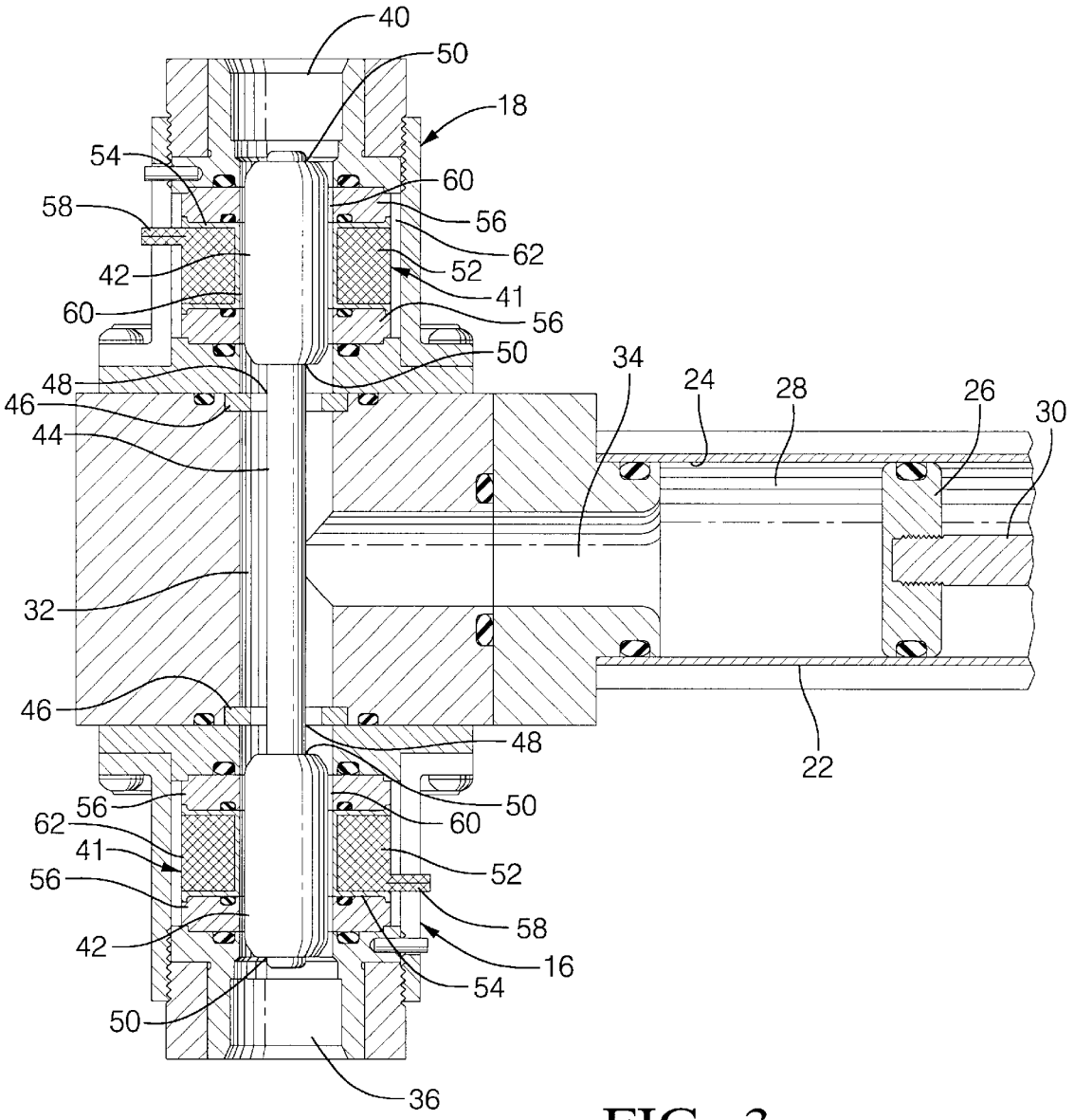
FIG. 3 is a cross sectional view of a portion of the pump of the present invention including the piston, inlet valve and outlet valve.

Referring to FIGS. 2A–2C, pump 12 includes a pump housing 22 containing a bore 24 and a piston 26 mounted for reciprocal movement in bore 24. A variable volume pump chamber 28 is formed on one side of piston 26 for receiving magnetorheological fluid for dispensing and delivery to a MR damper. A piston rod 30 is connected at one end to piston 26 and at an opposite end to stroke operator device 14 for moving piston 26 through a retraction stroke to the right as shown in FIG. 2C to permit fluid flow into pump chamber 28 and through a dispensing stroke to the left in FIG. 2C to dispense MR fluid from pump chamber 28. As most clearly shown in FIG. 3, pump housing 22 includes a common feed chamber 32 extending transversely relative to the longitudinal axis of bore 24. A connector chamber 34 extends between pump chamber 28 and common feed chamber 32. Pump housing 22 further includes an inlet port 36 communicating with common feed chamber 32 for delivering MR fluid from an MR fluid supply as shown in FIG. 1. An outlet circuit 38 is partially formed in pump housing 22 for directing fluid from pump chamber 28 toward an MR damper (not shown). Pump housing 22 includes an outlet port 40 positioned along outlet circuit 38 and at an opposite end of common feed chamber 32 from inlet port 36.

Both inlet valve 16 and outlet valve 18 include essentially the same components and therefore the same reference numerals will refer to common components. Both inlet and outlet valves 16, 18 include a magnetic field generating assembly 41 including a valve core 42 formed of a magnetic material, such as soft iron, securely mounted on one end of a support rod 44. Support rod 44 extends through both common feed chamber 32 and a pair of positioning disks 46 mounted on pump housing 22 and positioned in common feed chamber 32. Support rod 44 and thus valve cores 42 are axially and radially secured within common feed chamber 32 by positioning disks 46 and snap rings 48 mounted on support rod 44 which abut positioning disk 46 upon assembly. Valve core 42 may be mounted on support rod 44 in any conventional manner, such as by the use of snap rings 50 engaging complementary grooves in support rod 44 on both sides of valve core 42. Inlet valve 16 and outlet valve 18 further include a coil 52 mounted on a nonmagnetic metal bobbin 54 positioned concentrically around valve core 42. Each valve further includes annular flux pole pieces 56 positioned on each axial side of coil 52. Coil 52 is connected to an electrical source (not shown) via an electrical connector 58 extending through pump housing 22.

Bobbin 54 and pole pieces 56 are sized with a central passage and fixedly mounted relative to valve core 42 to form an annular flow gap 60 through which magnetorheological fluid is permitted to flow when the valve is open. The magnetorheological fluid may be any conventional fluid containing magnetic particles such as iron or iron alloys which can be controllably suspended within the fluid by controlling a magnetic field thereby varying the flow characteristics of the fluid through gap 60. An annular flux plate 62 formed of magnetic material is positioned around coil 52 and pole pieces 56 to guide the magnetic flux. The surrounding housing components are preferably formed of a nonmagnetic material so as to minimize flux leakage and maximize performance of the valve by ensuring optimum flux through the annular flow gap 60. Thus, in the present embodiment, the portions of annular flow gap 60 positioned between pole pieces 56 and valve core 42 function as magnetic control areas through which flux lines flow so that a magnetorheological effect occurs in the fluid contained in the control areas upon energization of the valve. Specifically, in an energized state, magnetic field generating assembly 41 generates a magnetic field across annular flow gap 60, and specifically in the control areas of the gap, to cause magnetorheological fluid flowing through the annular flow gap to experience a magnetorheological effect sufficient to prevent flow through annular flow gap 60. In a de-energized state, the electrical current to coil 52 is eliminated or reduced resulting in a rapid reduction or elimination of the magnetorheological effect on the fluid within annular flow gap 60 sufficient to permit fluid flow through annular flow gap 60 thereby opening the valve.

The present magnetorheological fluid pumping system may be used to dispense magnetorheological fluid during assembly and manufacture of an MR damper by dispensing fluid to an MR damper filling apparatus such as disclosed in co-pending U.S. Patent Application entitled "Magnetorheological Damper Charging System", Ser. No. 09/539,970 which is assigned to the assignee of the present invention and filed on the same day as the filing of the present application. The entire contents of that application is hereby incorporated by reference.

Stroke operator device 14 may be any device capable of effectively and controllably moving piston rod 30 and piston 26 through dispensing and retracting strokes under the control of electronic controller 20. For example, stroke operator device 14 may be a controlled stroke pneumatic cylinder capable of moving piston 26 through a predetermined stroke corresponding to a desired dispensed quantity of MR fluid for delivery to a MR damper. Therefore, system 10 may be used to dispense various predetermined quantities of MR fluid for delivery to MR dampers of various sizes requiring different fill quantities of MR fluid.

During operation, at the end of a dispensing stroke of piston 26, piston 26 begins moving to the right through a retraction stroke as shown in FIG. 2C. During the retraction stroke, magnetic field generating assembly 41 of outlet valve 18 is energized to generate a magnetic field across annular flow gap 60 to cause magnetorheological fluid flowing through the annular flow gap to experience a magnetorheological effect sufficient to prevent flow through gap 60. Simultaneously, magnetic field generating assembly 41 of inlet valve 16 is de-energized to permit flow through annular flow gap 60 of inlet valve 16 thereby permitting MR fluid flow from inlet port 36 through inlet valve 16, common feed chamber 32 and connector chamber 34 into pump chamber 28 as pump chamber 28 enlarges due to the movement of piston 26. Stroke operator device 14 terminates retracted movement of rod 30 and piston 26 at a predetermined point along bore 24 sufficient to permit a subsequent dispensing stroke of sufficient length corresponding to the volume of fluid to be dispensed. When dispensing of a predetermined quantity of MR fluid is desired, electronic controller 20 signals stroke operator device 14 which, in turn, moves rod 30 and piston 20 to the left as shown in FIG. 2C through a dispensing stroke of a predetermined length necessary to dispense a predetermined quantity of MR fluid from outlet port 40. Simultaneously, electronic controller 20 signals the de-energization of magnetic field generating assembly 41 of outlet valve 18 and the energization of magnetic field generating assembly 41 of inlet valve 16. As a result, MR fluid is permitted to flow through annular flow gap 60 of outlet valve 18 while fluid flow through annular flow gap 60 of inlet valve 16 is blocked by the magnetorheological effect experienced in gap 60 of inlet valve 16. Thus, MR fluid present in pump chamber 28 is forced through connector chamber 34, common feed chamber 32, annular flow gap 60 of outlet valve 18 and outlet port 40 through the remainder of outlet circuit 38 for delivery to the MR damper. Upon movement of piston 26 through a predetermined dispensing stroke length, electronic controller 20 signals stroke operator device 14 to stop the movement of piston 26 while simultaneously energizing magnetic field generating assembly 41 of outlet valve 18 and de-energizing magnetic field generating assembly 41 of inlet valve 16. Stroke operator device 14 may immediately be operated to move through the retraction stroke in preparation for the next dispensing operation or remain in the advanced dispense position until the next dispensing operation depending on the control scheme desired. Accordingly, during dispensing operation, flow through inlet valve 16 is blocked causing fluid from pump chamber 28 to flow entirely through outlet valve 18. Likewise, during the retraction stroke, MR fluid from outlet port 40 is prevented from flowing in a reverse direction through outlet valve 18 into common feed chamber 32 while supply MR fluid flows through inlet valve 16 into pump chamber 28.

Figure 4A:
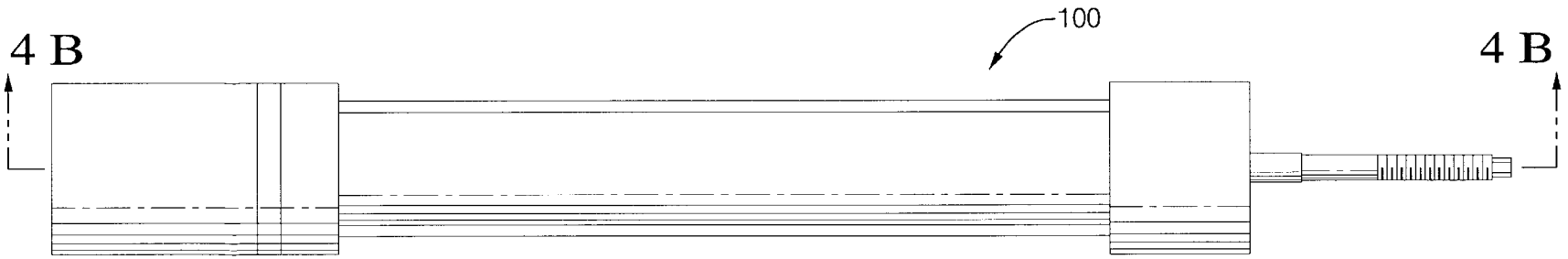
FIG. 4A is a plane view of a pump in accordance with a second embodiment of the present invention.
Figure 4B:
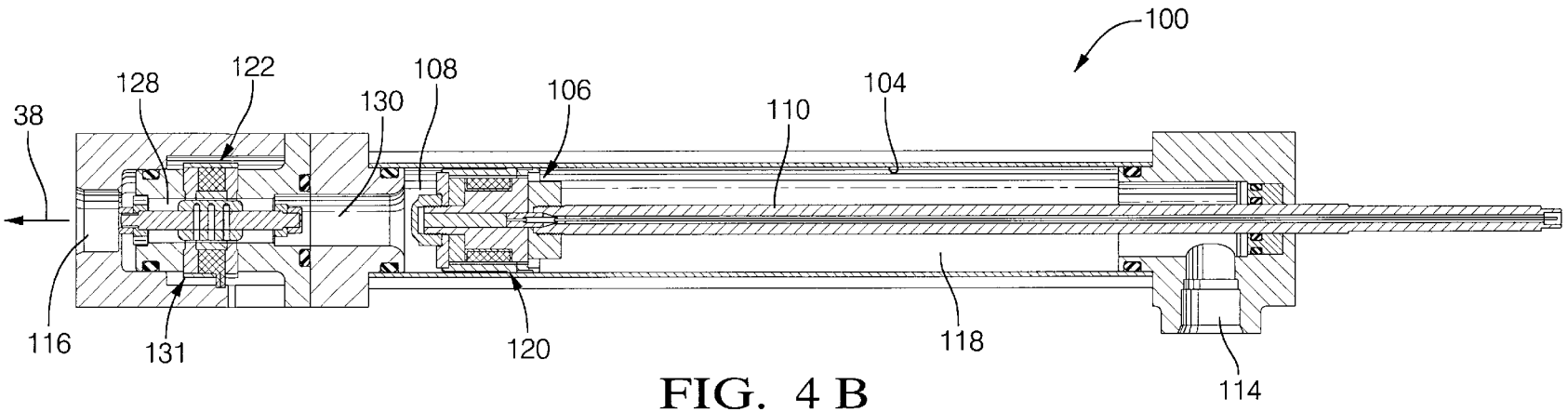
FIG. 4B is a cross sectional view of the pump of FIG. 4A taken along plane 4B—4B.
Figure 5:
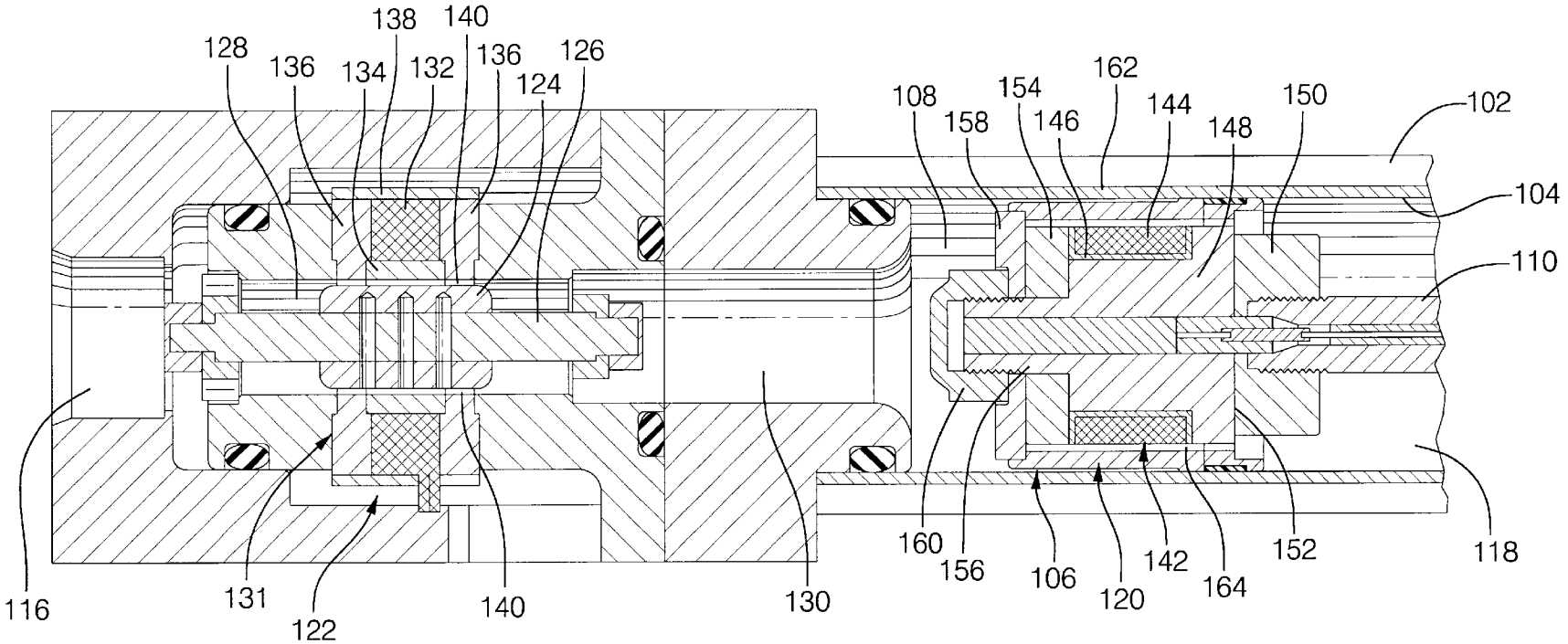
FIG. 5 is a cross sectional view of the outlet valve, piston and inlet valve at one end of the pump of FIG. 4B.

Referring now to FIGS. 4A, 4B and 5, a second embodiment of a pump for use in the magnetorheological fluid pumping system 10 of FIG. 1 is shown. The pump 100 of the present embodiment may be used as an alternative to the pump 12 of FIGS. 2A–2C to effectively dispense MR fluid in predetermined controlled amounts for delivery to a MR damper. As shown in FIGS. 4A and 4B, pump 100 includes a pump housing 102 including a cylindrical bore 104 and a piston 106 mounted for reciprocal movement in bore 104. A pump chamber 108 is formed in bore 104 on one side of piston 106. A piston rod 110 is connected at one end to piston 106 and extends through bore 104 and outwardly through housing 102 via a seal 112 to connect with stroke operator device 14 of FIG. 1. An inlet port 114 is formed at one end of pump housing 102 while an outlet port 116 is formed at an opposite end. Inlet port 114 communicates with a receiving chamber 118 for receiving a supply of MR fluid. An inlet valve 120 is mounted on or integrated into piston 106 while an outlet valve 122 is mounted at one end of pump housing 102 adjacent outlet port 116.

Outlet valve 122 is similar to the outlet valve of the previous embodiment in that it includes a magnetic field generating assembly 131 including a valve core 124 mounted on a support rod 126. In the present embodiment, support rod 126 is positioned in a feed chamber 128 connected at one end to a connector passage 130 and at an opposite end to outlet port 116. Support rod 126 and valve core 124 may be mounted in feed chamber 128 in any manner sufficient to prevent radial and axial movement of valve core 124. Magnetic field generating assembly 131 further includes a coil 132 mounted on a nonmagnetic bobbin 134 and annular pole pieces 136 mounted on both sides of coil 132. In addition, an annular flux plate 138 is mounted on the outer circumference of coil 132 and pole pieces 136 to complete the flux circuit. Preferably, magnetic field generating assembly 131 is mounted on housing components formed of nonmagnetic material to minimize flux leakage. An annular flow gap 140 is formed between the outer surface of valve core 124 and the inner surface of pole pieces 136 and bobbin 134. As with the previous embodiment, the effective control areas of the annular flow gap 140 are formed between valve core 124 and pole pieces 136. In the de-energized state, little or no flux is generated in annular flow gap 140 thus permitting MR fluid to flow from pump chamber 108 through connector passage 130, feed chamber 128 and outlet port 116 for delivery to, for example, an MR damper filling apparatus. Coil 132 includes an electrical connector 133 for connection to electronic control 20 of FIG. 1.

Inlet valve 120 includes a magnetic field generating assembly 142 integrated into piston 106 so as to permit the flow of MR fluid from receiving chamber 118 to pump chamber 108 in the de-energized state and blocking the flow of MR fluid from pump chamber 108 to receiving chamber 118 in the energized state. Magnetic field generating assembly 142 in combination with piston 106 may be essentially the same in structure as those disclosed as suitable for use in MR dampers themselves. Magnetic field generating assembly 142 generally includes a coil 144 mounted on a bobbin 146 positioned on a piston core 148 formed of magnetic material. Piston rod 110 is connected to piston core 148 via a first end plate 150 which, in turn, is connected to piston core 148 by a brazed connection at interface 152. Magnetic field generating assembly 142 also includes a pole piece 154 mounted on a threaded boss 156 extending from piston core 148. A second end plate 158 is positioned on boss 156 followed by a securing nut 160. Magnetic field generating assembly 142 also includes an annular flux ring 162 positioned around piston core 148, coil 144 and pole piece 154 to form an annular flow gap 164. Annular flux ring 162 is held in position between first and second end plates 150 and 158, respectively. Annular flow gap 164 permits flow between receiving chamber 118 and pump chamber 108 when magnetic field generating assembly 142 is in the de-energized state as described more fully hereinbelow. Alternative structures which could be used are shown, for example, in co-pending U.S. patent application Ser. No. 09/397,241, filed Sep. 16, 1999 and entitled "Magnetorheological Fluid Damper with Optimum Damping," or U.S. patent application Ser. No. 09/494,977, filed Jan. 31, 2000 and entitled "Magnetorheological Fluid Damper". Both these applications are assigned to the assignee of the present application, and their disclosures are hereby incorporated by reference.

During operation, at the beginning of a retraction stroke as shown in FIG. 4B, electronic controller 20 (FIG. 1) signals stroke operator device 14 to pull piston rod 110 to the right as shown in FIG. 4B. Simultaneously, magnetic field generating assembly 142 of inlet valve 120 is de-energized to permit fluid flow from receiving chamber 118 through annular flow gap 164 into pump chamber 108 as piston 106 moves to the right as shown in FIG. 4B. Simultaneously, electronic controller 20 signals for the energization of magnetic field generating assembly 131 of outlet valve 122 thereby blocking any fluid flow from outlet port 116 through outlet valve 122 toward connector passage 130 and pump chamber 108. Thus, MR fluid which had flowed into receiving chamber 118 via inlet port 114 as piston 106 moved through a dispensing stroke in the previous cycle is moved into pump chamber 108 during the retraction stroke causing pump chamber 108 to fill with MR fluid. Piston 106 will of course terminate its movement through the retraction stroke at a predetermined position along bore 104 so as to enlarge and fill pump chamber 108 with at least the amount of MR fluid required for a particular filling operation. When dispensing of MR fluid is desired, electronic controller 20 signals stroke operator device 14 to move piston rod 110 and piston 106 through a dispensing stroke of a predetermined length depending on the volume of MR fluid required for a particular MR damper fill operation. Simultaneously, magnetic field generating assembly 142 of inlet valve 120 is energized to prevent the flow of MR fluid from pump chamber 108 through annular flow gap 164 into receiving chamber 118. Thus, a magnetic field is generated across annular flow gap 164 to cause magnetorheological fluid flowing through gap 164 to experience a magnetorheological effect sufficient to prevent flow through the gap. Simultaneously, electronic controller 20 signals for the de-energization of magnetic field generating assembly 131 of outlet valve 122 causing outlet valve 122 to open. As a result, piston 106 functions to pump MR fluid from pump chamber 108 through connector passage 130 and annular flow gap 140 for delivery to a MR damper filling device via outlet port 116. During the dispensing stroke, a new supply of MR fluid is delivered to receiving chamber 118 via inlet port 114 as receiving chamber 118 enlarges due to the movement of piston 106 to the left as shown in FIG. 4B. When a sufficient amount of MR fluid has been dispensed, the electronic controller delivers a signal to valve operator device 14 to terminate dispensing movement of the piston while at the same time energizing outlet valve 122 and de-energizing inlet valve 120. Preferably, stroke operator device 114 then proceeds through a retraction stroke forcing fluid from receiving chamber 118 into pump chamber 108 in preparation for another dispensing operation.

We claim:

1. A magnetorheological fluid pumping system for dispensing fluid for delivery to a magnetorheological device, comprising:

a pump including a bore and a piston mounted for reciprocal movement in said bore to form a pump chamber, said piston movable through a retraction stroke to permit fluid flow into said pump chamber and a dispensing stroke to dispense fluid from said pump chamber; and an outlet circuit for directing flow from said pump chamber;

an outlet valve positioned along said outlet circuit for controlling fluid flow from said pump chamber, said outlet valve including an annular flow gap and a magnetic field generating assembly operable in an energized state to generate a magnetic field across said annular flow gap to cause magnetorheological fluid flowing through said annular flow gap to experience a magnetorheological effect sufficient to prevent flow through said annular flow gap and in a de-energized state to permit flow through said annular flow gap.

2. The system of claim 1, further including an inlet valve for controlling fluid flow into said pump chamber, said inlet valve including an annular flow gap and a magnetic field generating assembly operable in an energized state to generate a magnetic field across said annular flow gap to cause magnetorheological fluid flowing through said annular flow gap to experience a magnetorheological effect sufficient to prevent flow through said annular flow gap and in a de-energized state to permit flow through said annular flow gap into said pump chamber.

3. The system of claim 2, wherein said pump includes a pump housing, said outlet valve and said inlet valve being mounted on said pump housing.

4. The system of claim 2, further including an electronic controller connected to said inlet valve and said outlet valve for controlling the energization and de-energization of said respective magnetic field generating assemblies.

5. The system of claim 4, further including a stroke operator device for moving said piston through said retraction and said dispensing strokes.

6. The system of claim 3, wherein said outlet valve is positioned in axial alignment with a longitudinal stroke axis of said piston.

7. The system of claim 2, wherein said inlet valve is mounted on said piston.

8. The system of claim 6, wherein said inlet valve is mounted on said piston.

9. The system of claim 3, wherein said pump includes a common feed chamber positioned at one end of said bore, said inlet and said outlet valves positioned along said common feed chamber a spaced distance from one another, said bore extending transversely from said common feed chamber.

10. The system of claim 3, wherein said pump includes a pump inlet port at a first end and an outlet port at a second end opposite said first end, said outlet valve positioned adjacent said outlet port.

11. A magnetorheological fluid pumping system for dispensing fluid for delivery to a magnetorheological device, comprising:

a pump including a bore, an outlet port, an inlet port and a piston mounted for reciprocal movement in said bore to form a pump chamber, said piston movable through a retraction stroke to permit fluid flow into said pump chamber and a dispensing stroke to dispense fluid from said pump chamber through said outlet port for delivery to the device; and an inlet valve mounted on said pump to control fluid flow into said pump chamber, said inlet valve including an annular flow gap and a magnetic field generating assembly operable in an energized state to generate a magnetic field across said annular flow gap and in a de-energized state, said annular flow gap sized to permit magnetorheological fluid flowing through said annular flow gap to experience a magnetorheological effect sufficient to prevent flow through said annular flow gap when said magnetic field generating assembly is in said energized state and to permit flow through said annular flow gap into said pump chamber when said magnetic field generating assembly is in said de-energized state.

12. The system of claim 11, further including an outlet valve for controlling fluid flow from said pump chamber, said outlet valve including an annular flow gap and a magnetic field generating assembly operable in an energized state to generate a magnetic field across said annular flow gap to cause magnetorheological fluid flowing through said annular flow gap to experience a magnetorheological effect sufficient to prevent flow through said annular flow gap and in a de-energized state to permit flow through said annular flow gap.

13. The system of claim 12, further including a stroke operator device for moving said piston through said retraction and dispensing strokes, wherein said stroke operator device and said outlet valve are mounted on said pump.

14. The system of claim 12, further including an electronic controller connected to said inlet valve and said outlet valve for controlling the energization and de-energization of the respective magnetic field generating assemblies.

15. The system of claim 13, wherein said outlet valve is positioned in axial alignment with a longitudinal stroke axis of said piston.

16. The system of claim 12, wherein said inlet valve is mounted on said piston.

17. The system of claim 15, wherein said inlet valve is mounted on said piston.

18. The system of claim 12, wherein said pump further includes a common feed chamber positioned at one end of said bore, said inlet and said outlet valves positioned along said common feed chamber a spaced distance from one another, said bore extending transversely from said common feed chamber.

19. The system of claim 12, wherein said inlet port is positioned at a first end of said pump and said outlet port is positioned at a second end of said pump opposite said first end, said outlet valve positioned adjacent said outlet port.

20. A method of dispensing magnetorheological fluid for delivery to a magnetorheological device, comprising the steps of:

providing a pump including a bore and a piston mounted for reciprocal movement in said bore to form a pump chamber;

reciprocating said piston through a retraction stroke to permit fluid flow into said pump chamber and a dispensing stroke to dispense fluid from said pump chamber;

providing an inlet valve to control fluid flow into said pump chamber, said inlet valve including an annular flow gap and a magnetic field generating assembly operable in an energized state to generate a magnetic field across said annular flow gap to cause magnetorheological fluid flowing through said annular flow gap to experience a magnetorheological effect sufficient to prevent flow through said annular flow gap and in a de-energized state to permit flow through said annular flow gap into said pump chamber;

providing an outlet valve for controlling fluid flow from said pump chamber, said outlet valve including an annular flow gap and a magnetic field generating assembly operable in an energized state to generate a magnetic field across said annular flow gap to cause magnetorheological fluid flowing through said annular flow gap to experience a magnetorheological effect sufficient to prevent flow through said annular flow gap and in a de-energized state to permit flow through said annular flow gap;

maintaining said outlet valve magnetic field generating assembly in said energized state and said inlet valve magnetic field generating assembly in said de-energized state during said retraction stroke of said piston; and maintaining said outlet valve magnetic field generating assembly in said de-energized state and said inlet valve magnetic field generating assembly in said energized state during said dispensing stroke of said piston.

* * * * *